United States Patent [19]

Neuland et al.

[11] 4,300,300

[45] Nov. 17, 1981

[54] DISPLAY BOARDS

[76] Inventors: Erich Neuland; Rudolf L. Neuland, both of 3 Michael Seiler Strasse, Kunzell, Fed. Rep. of Germany, 6411

[21] Appl. No.: 109,530

[22] Filed: Jan. 4, 1980

[30] Foreign Application Priority Data

Feb. 9, 1979 [DE] Fed. Rep. of Germany ..... 2904871

[51] Int. Cl.[3] ..... G09F 15/00

[52] U.S. Cl. ..... 40/610; 40/611; 248/456; 248/461

[58] Field of Search ..... 248/451, 452, 453, 456, 248/461, 408, 409, 188.5, 445; 40/152.1, 610, 156, 611, 612; 160/351, 24, 135; 312/231

[56] References Cited

U.S. PATENT DOCUMENTS

| | | | |
|---|---|---|---|
| 559,572 | 5/1896 | Devoe | 248/188.5 |
| 2,064,232 | 12/1936 | Tepper | 248/460 |
| 2,538,318 | 1/1951 | Mitchell | 248/455 |
| 2,719,688 | 10/1955 | Seifert | 248/188.5 |
| 3,103,375 | 9/1963 | McMullin | 248/188.5 |
| 3,623,691 | 11/1971 | Albee | 248/454 |

FOREIGN PATENT DOCUMENTS

| | | | |
|---|---|---|---|
| 136419 | 4/1880 | France | 248/461 |
| 69504 | 1/1944 | Norway | 248/460 |

*Primary Examiner*—Gene Mancene
*Assistant Examiner*—G. Lee Skillington
*Attorney, Agent, or Firm*—Cantor and Singer

[57] ABSTRACT

A display board comprises a frame, two longitudinally displaceable legs extending in the plane of the board, a support articulated to the top of the display board and arranged to be swung at an angle to the plane of the board and a pair of struts between the board and the support to secure the latter in a swung-out position. Each of the struts is articulated to a respective leg of the board and to a component which is axially displaceable to a limited extent on the support. When the support is swung-in to a position in which it extends substantially parallel to the plane of the frame, the articulation points of the struts on the respective legs are located above the said axially displaceable component and therefore above the articulation points of the struts on the support. An extension member is telescopically arranged in the support and can be secured in position by a clamping member mounted on the support. The clamping member also serves to limit axial movement of the axially displaceable component.

9 Claims, 6 Drawing Figures

DISPLAY BOARDS

BACKGROUND OF THE INVENTION

The invention relates to a display board having a frame, two longitudinally displaceable legs extending in the plane of the board, a support articulated to the top of the display board and arranged to be swung at an angle to the plane of the board and at least one strut between the board and the support to secure the latter in a swungout position.

Display boards of this type have been increasingly used of late as an aid for lectures, presentations and for instructional purposes. It is of particular importance with such boards that, unlike heavy school blackboards, they can be easily transported, because they are not always used at the same location and instead frequently have to be taken by a lecturer into the room in which a lecture, discussion or presentation is to take place.

The hitherto known frames for such boards caused considerable difficulty on being set up. It was firstly necessary to place the board on its side, followed by pulling out a leg extension and locking it, after which the board was placed on its other side and the second leg extension pulled out and locked. It was then necessary to lift up the board so that it could stand on its two legs, followed by folding out the support, after which a support extension was pulled out and locked. Finally a strut connecting the legs to the support had to be fixed to the latter. All these activities are very time-consuming and were considered to be particularly disadvantageous, for example at a presentation or lecture if the lecturer had to come into the room with the board and then set it up in front of the audience.

SUMMARY OF THE INVENTION

The object of the invention is to provide a board of the type indicated hereinbefore which takes up the minimum amount of space in the assembled state and which can be easily assembled without it being necessary to place the board on its side during erection.

Accordingly, the present invention provides a display board having a frame, two longitudinally displaceable legs extending in the plane of the board, a support articulated to the top of the display board and arranged to be swung at an angle to the plane of the board, at least one strut between the board and the support to secure the latter in a swungout position, said strut being articulated to a leg of the board and to a component which is axially displaceable to a limited extent on said support and, with the support swungin to a position in which it extends substantially parallel to the plane of the frame, the articulation point of the strut on said leg being located above said axially displaceable component and therefore above the articulation point of the strut on said support.

The advantages brought about by the invention are mainly that in erecting the board for use, the legs can be easily extended from the board and that in a completely independent manner during the extension of the legs, the support can be swung away from the board and automatically held in this swung-out position by a strut. There is consequently no need to tilt the board backwards and forwards and it can be set up with the minimum of manipulation.

The frame preferably has a profile cross section with vertically directed side parts, said legs being displaceably mounted in the side parts. As a result of this measure, the display board can be made particularly compact and slimline, whilst also having a very attractive and clean appearance.

Each of the side parts preferably has a longitudinally directed slot through which a respective strut is articulated to a respective leg. As a result of this, the support and the strut can be placed against the back of the board when the legs are fully raised. Consequently the support and the strut need not project beyond the contour of the frame of the display board, so that the board is extremely narrow, which is important for transportation purposes.

The legs may be formed by the limbs of a U-shaped member so that, during the setting up of the board, the foot can be placed on the base of the U-shaped member and both legs will then simultaneously be extended from the vertical side parts of the frame.

According to a preferred embodiment of the invention, the profile frame comprises a closed box profile, the free end of each leg is provided with a guide block dimensioned in accordance with the free cross section of the box profile and each guide block contains a locking bolt which is biased by a spring at right angles to the box profile and which, in two end positions of the associated leg, can be engaged in a hole provided in the box profile.

A particularly easy displaceability of the legs in the vertical side parts of the frame and at the same time a particularly easy locating of the legs in their end positions can be obtained by these measures.

A clamping member is desirably mounted on the support, said vertically displaceable component being movable against the clamping member, which thus acts as a stop member. An extension member may be telescopically mounted in the support, the clamping member serving to lock the extension member in any, preferably random, position.

As a result of this, the inclined position of the erected display board can be selected at random.

According to a further preferred feature of the invention, the frame is substantially rectangular having an upper horizontal part and a lower horizontal part interconnected by two vertical parts, said frame further having a U-shaped cross section which is open towards the inside of the board for receiving a visual display surface and, towards the outside thereof, a cross-sectionally U-shaped part for receiving a ledge and/or handle. The frame is desirably made of extruded aluminum so that it is easily possible to give it this shape.

A ledge which is movable towards the side of the display board is desirably arranged on the upper horizontal part of the frame on the outwardly directed U-shaped part so that it is possible, by moving the ledge sideways to project from the side of the display surface of the board to attach further sheets of paper or other visual display means. It is also possible to provide two such ledges on the upper horizontal part of the frame so that additional information carriers can be fixed to both sides of the display board.

A storage surface may be pivotally mounted on the lower horizontal part of the frame in order to store, for example, drawing pins. Since this storage surface is pivotally mounted on the board, it can be pivoted to a position in which it extends substantially parallel to the plane of the board so as to take up the minimum amount of space when not required for use.

BRIEF DESCRIPTION OF THE DRAWINGS

The invention will now be further described, by way of exafnple, with reference to the drawings, in which.

DESCRIPTION OF PREFERRED EMBODIMENT

Figure 1:
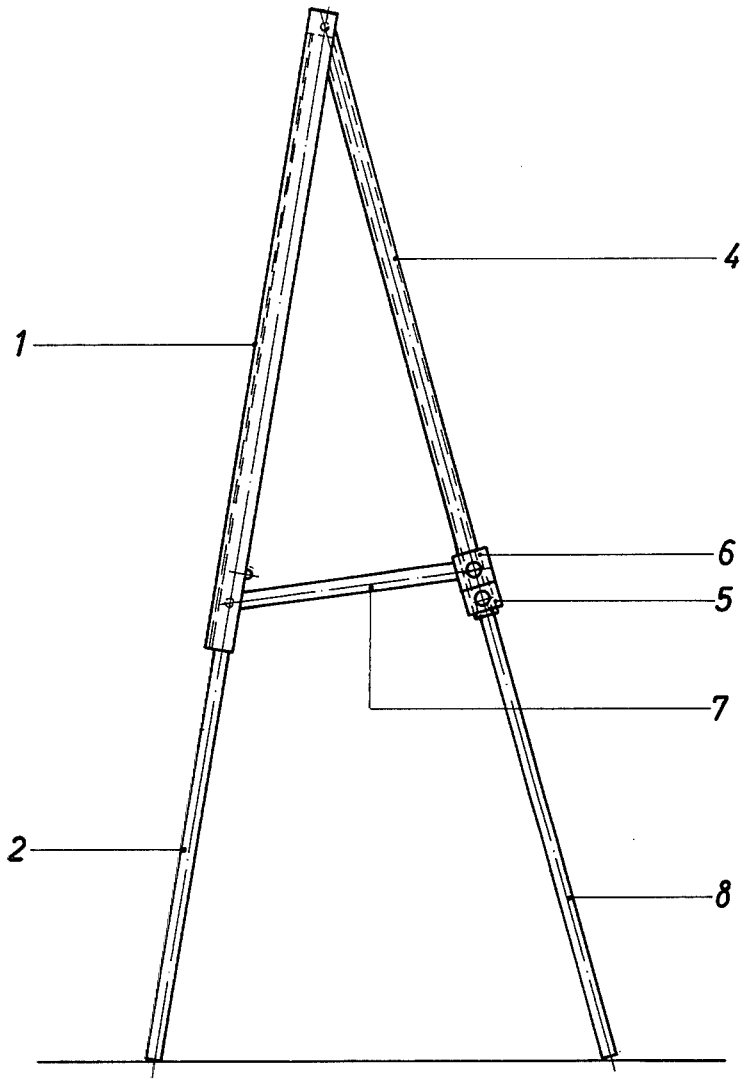
FIG. 1 is a side elevation of one embodiment of a display stand according to the invention in the erected condition.

FIG. 1 shows a profile frame 1 which borders the visual display surface of the board. Legs can be extended from the said profile frame 1, one leg 2 being shown in FIG. 1. A support 4 is articulated to the profile frame 1 at the top of the board. This support 4 has at its end a clamping member 5 which can secure or release an extension member 8 which can in turn be extended out of or retracted into the support 4. An axially displaceable component 6 is arranged above the clamping member 5 on the support 4 and to said component 6 is articulated a strut 7, which is also fixed in articulated manner to the leg 2.

Figure 2:
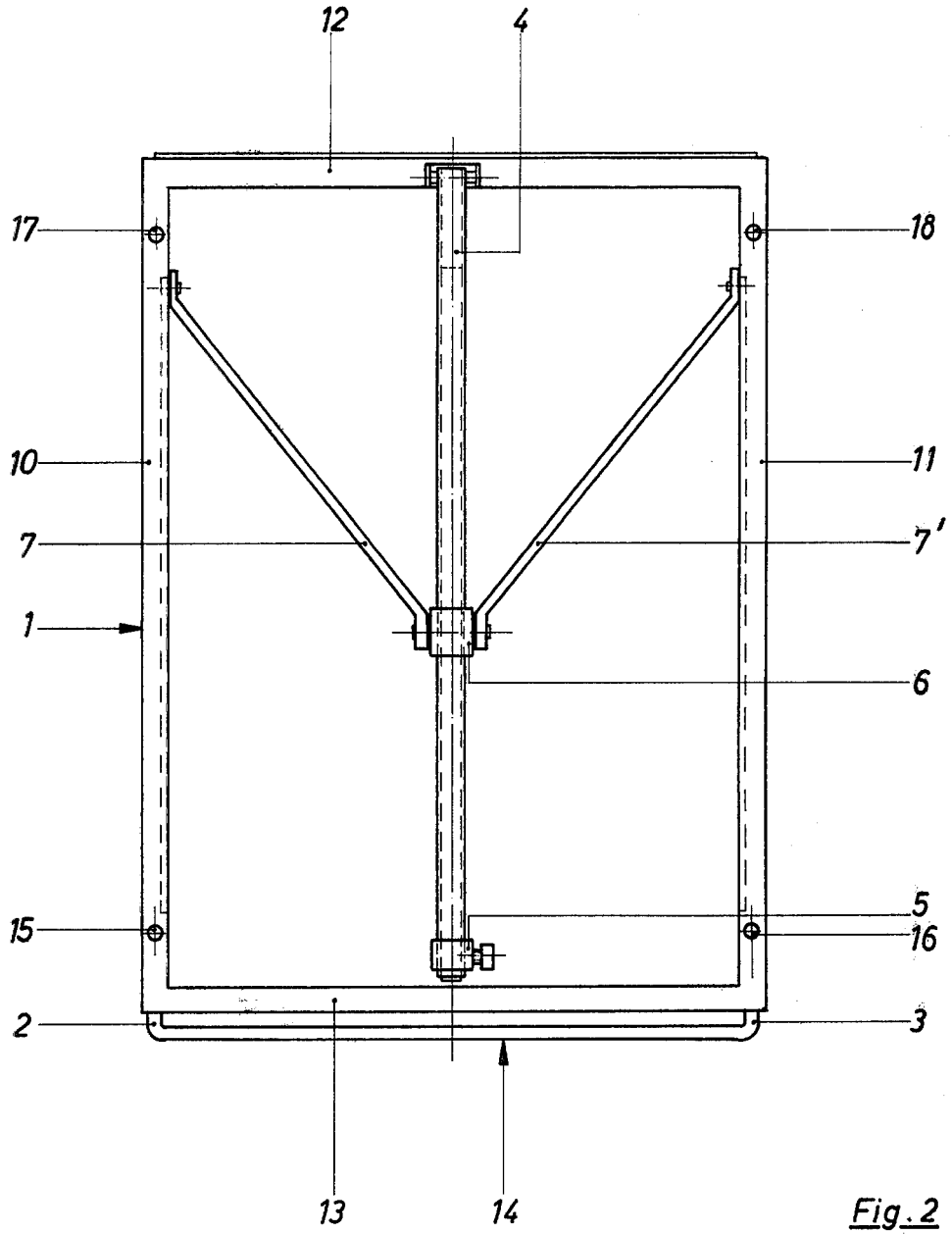
FIG. 2 is a rear view of the board illustrated in FIG. 1 but showing the board in the folded down or collapsed condition.

FIG. 2 shows the mechanism of the frame holding the display surface of the board. It is firstly possible to see the profile frame 1 comprising vertical side parts 10 and 11, as well as an upper horizontal profile part 12 and a lower horizontal profile part 13. A U-shaped member 14 has two free portions forming the legs 2 and 3 of the board. These legs 2 and 3 are slidable respectively into the side parts 10 and 11 of the profile frame. By pressing down locking bolts 17 and 18 it is possible to extend the U-shaped member 14 out of the side parts 10 and 11 until the locking bolts 17, 18 are able to engage in locking holes 15, 16 at the lower end of the side parts 10 and 11 respectively. This drawing out of the U-shaped member 14 is in practice brought about by placing the foot on the horizontal portion of the U-shaped member 14 and raising the frame of the board. As the frame is raised, the support 4 is raised with it. If the screw of the clamping member 5 has been previously loosened, the extension member 8 automatically slides out of the support 4, so that it has a continuous contact with the floor.

Struts 7, 7′ are articulated respectively to legs 2, 3 and these articulation points do not therefore change position during the raising of the frame. The displaceable component 6 slides on the support 4 until it comes against the clamping member 5. The clamping member 5 then has the tendency to raise the struts 7, 7′ which brings about a swinging out of the struts 7, 7′ and the support 4. When the frame has been raised to such an extent that the locking bolts 17 and 18 on the legs 2 and 3 are located in the locking holes 15 and 16, it is merely necessary to tighten the screw of the clamping member 5 for the extension member 8 to be locked in the support 4, after which the board stands securely.

Figure 3:
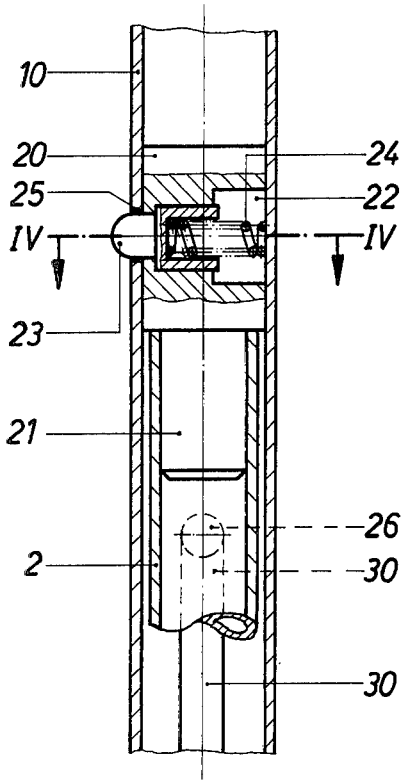
FIG. 3 is a section through a side part of the display board shown in FIGS. 1 and 2 in the vicinity of the articulation of a strut to a leg of the board.
Figure 4:
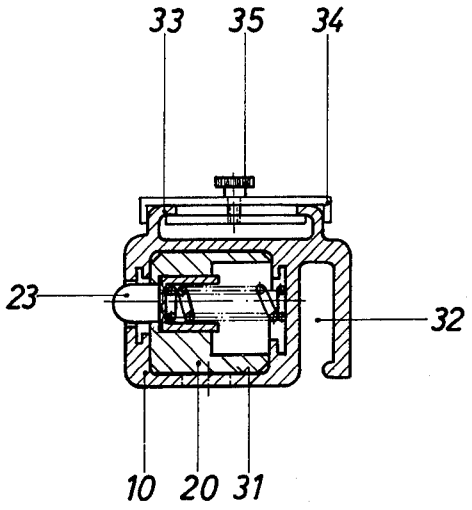
FIG. 4 is a cross section through the side part taken on the line IV—IV in FIG. 3 in the direction of the arrows.

FIGS. 3 and 4 show more clearly the guidance of leg 2 in the side part 10. The leg 3 is guided in the side part 11 in an identical manner. The U-shaped member 14 and consequently the legs 2 and 3 are tubular in this embodiment.

A guide block 20 made from a plastics material with good sliding characteristics, for example a polyamide is mounted on the ends of each of the legs 2 and 3, so that block 20 with a pin 21 projects into the particular leg 2 or 3.

A stepped bore 22 is provided in the guide block 20 at right angles to the main extension direction of the associated leg 2 or 3. A locking bolt 23 with a rounded head is arranged in axially displaceable manner in the bore 22. A spring 24 biases the locking bolt 23 in the direction of the wall of side part 10 or 11. In the end position shown in FIGS. 3 and 4 the rounded head of the locking bolt 23 projects from a bore 25 of side part 10, so that as a result the leg 2 is locked in the inserted position.

In order to bring about the necessary articulation of the strut 7, 7′ on each leg 2 or 3, a bore 26 is provided at the articulation point in each leg, as indicated by broken lines in FIG. 3. A long slot 30 is provided in each side wall 10 or 11 of the profile frame 1.

The sectional view of FIG. 4 shows the construction of profile frame 1, particularly the side parts 10 and 11. Each side part comprises a box profile 31 into which is slid a respective guide block 20. Alongside box profile 31 there is a U-shaped section 32, which serves to bound the visual display surface of the board (not shown) and therefore secure the same. In FIG. 4, a U-shaped part 33 is provided above the box profile 31 and this serves a number of functions. In the case of side parts 10 and 11 and the lower horizontal profile part 13, the U-shaped part 33 serves solely to receive a ledge. In the case of the upper horizontal profile part 12, the U-shaped part 33 additionally serves to secure a handle or grip (not shown) for carrying the board according to the invention. Furthermore, and as shown in FIG. 4, a ledge 34 is axially displaceably arranged on the U-shaped part 33 by means of a screw 35. After loosening screw 35, this ledge can be moved to one side of the board, so that further visual display aids can be hung on it. It is also possible to have two such ledges 34, so that they can project to either side of the board.

Figure 5:
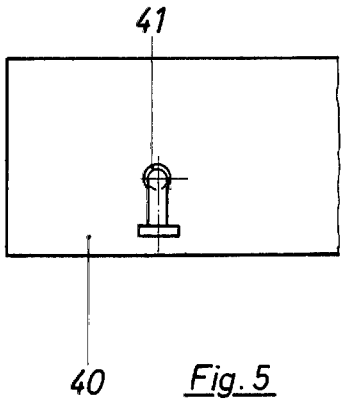
FIG. 5 is a front elevation of part of a shelf which is pivotally mounted on the frame at the lower end of the board, said shelf being shown in the folded-up storage position.
Figure 6:
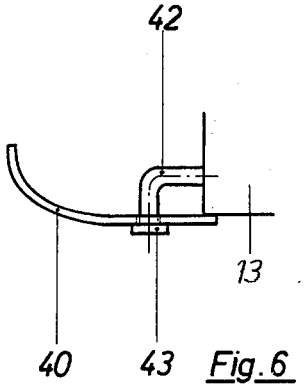
FIG. 6 is a side elevation of the shelf shown in FIG. 5 in the pivoted-down position for use.

FIGS. 5 and 6 show a shelf 40 fixed to the lower horizontal profile part 13 of the frame. Fixing takes place essentially by two U-shaped arms 42, fixed to the lower horizontal profile part 13, guided through holes 41 in the shelf 40 and below the holes retaining the shelf 40 by respective heads 43. As a result of this construction, it is possible to guide the shelf 40 by raising along the U-shaped arms 42 and to bring the said shelf into a position parallel to the plane of the display board so that, during transportation of the board, the shelf does not project very far beyond the thickness of the board.

The invention is not restricted to the above described embodiment but modifications and variations may be made without departing from the scope of the invention.

We claim:

1. An easel comprising:

a. a top;

b. a pair of side frame members fixed at one end of the top, each side frame member defining an enclosed channel and having a longitudinally directed slot;

c. a pair of legs telescopically mounted in said channels;

d. an elongated support member pivotally mounted at one end to the top at a location intermediate the side frame members;

e. a sleeve member slidingly mounted on said support member; and f. a pair of struts pivotally mounted at one end to said sleeve member and at the other end to the upper end portion of a respective one of said legs through said slot.

2. An easel as claimed in claim 1, in which said two legs are formed by the limbs of a U-shaped member which is introduced into said side frame members from the lower end thereof.

3. An easel as claimed in claim 2, in which each side frame member comprises four sides, further comprising a guide block fixed at the upper end of each leg member, each guide block containing a locking bolt which is biased by a spring transverse to the axis of the leg member, and a hole at each end portion of the associated leg into which said locking bolt can be engaged.

4. An easel as claimed in claim 1, further comprising a clamping member on said support, said sleeve member being movable against said clamping member, an extension member telescopically mounted in said support, said clamping member further serving to lock said extension member in position.

5. An easel as claimed in claim 4, in which said clamping member is effective to lock said extension member in any random position.

6. An easel as claimed in claim 1, in which said two legs are locatable in the extended end positions.

7. An easel as claimed in claim 1, in which the frame is substantially rectangular having an upper horizontal part forming the top and a lower horizontal part interconnected by said side frame members, said frame further having a U-shaped cross section which is open towards the inside of the board for receiving a visual display surface and, towards the outside thereof, a cross-sectionally U-shaped part for receiving a ledge and/or a handle.

8. An easel as claimed in claim 7, in which a ledge which is movable towards the side of the display board is arranged on the upper horizontal part of the frame on the outwardly directed U-shaped part.

9. An easel as claimed in claim 7, in which a storage surface is pivotally mounted on the lower horizontal part of the frame.

* * * * *